US005599787A

United States Patent [19]

Schmid et al.

[11] Patent Number: 5,599,787

[45] Date of Patent: Feb. 4, 1997

[54] AQUEOUS ANIONIC SURFACTANT SOLUTIONS STABLE AT LOW TEMPERATURE COMPRISING GLYCOSIDE AND ALKOXYLATED NONIONIC SURFACTANT MIXTURES AND PROCESSES OF MAKING SAME

[75] Inventors: Karl Schmid, Mettmann; Brigitte Giesen; Andreas Syldath, both of Duesseldorf, all of Germany

[73] Assignee: Henkel Kommanditgesellschaft auf Aktien, Duesseldorf, Germany

[21] Appl. No.: 428,109

[22] PCT Filed: Oct. 21, 1993

[86] PCT No.: PCT/EP93/02914

§ 371 Date: Jun. 19, 1995

§ 102(e) Date: Jun. 19, 1995

[87] PCT Pub. No.: WO94/10279

PCT Pub. Date: May 11, 1994

[30] Foreign Application Priority Data

Oct. 29, 1992 [DE] Germany ..... 42 36 506.6

[51] Int. Cl.[6] ..... C11D 3/22; C11D 1/825; C11D 1/83; C11D 11/00

[52] U.S. Cl. ..... 510/535; 510/235; 510/236; 510/237; 510/405; 510/427; 510/470; 510/537

[58] Field of Search ..... 252/174.17, 174.21, 252/174.22, DIG. 1, 173, DIG. 14, 89.1

[56] References Cited

U.S. PATENT DOCUMENTS

| | | | |
|---|---|---|---|
| 4,483,779 | 11/1984 | Llenado et al. | 252/135 |
| 4,483,780 | 11/1984 | Llenado | 252/135 |
| 5,025,069 | 6/1991 | Deguchi et al. | 252/174.17 |
| 5,370,816 | 12/1994 | Balzer et al. | 252/132 |
| 5,374,716 | 12/1994 | Biermann et al. | 536/18.6 |
| 5,389,282 | 2/1995 | Saijo et al. | 252/174.17 |
| 5,417,891 | 5/1995 | Gomes et al. | 252/552 |

FOREIGN PATENT DOCUMENTS

| | | |
|---|---|---|
| 0070075 | 1/1983 | European Pat. Off. . |
| 0070074 | 1/1983 | European Pat. Off. . |
| 0070076 | 1/1983 | European Pat. Off. . |
| 0075995 | 4/1983 | European Pat. Off. . |
| 0075996 | 4/1983 | European Pat. Off. . |
| 0202638 | 11/1986 | European Pat. Off. . |
| 0301298 | 2/1989 | European Pat. Off. . |
| 0347110 | 12/1989 | European Pat. Off. . |
| 0405967 | 1/1991 | European Pat. Off. . |
| 0474915 | 3/1992 | European Pat. Off. . |
| 4005108 | 8/1991 | Germany . |
| 4009533 | 9/1991 | Germany . |
| 4025065 | 2/1992 | Germany . |
| 4039223 | 6/1992 | Germany . |
| 4105602 | 8/1992 | Germany . |
| 9003977 | 4/1990 | WIPO . |
| 9202604 | 2/1992 | WIPO . |

OTHER PUBLICATIONS

Seifen–Öle–Fette–Wachse 115, 149 (1989) (no month available).

J. Falbe (ed.), "Surfactants in Consumer Products", Springer Verlag, Berlin, 1987, pp. 54 to 124 (no month available).

J. Falbe (ed.), "Katalysatoren, Tenside und Mineralöladditive" (Catalysts, Surfactants and Mineral Oil Additives), thieme Verlag, Stuggart, 1978, pp. 123–217 (no mo. available).

*Primary Examiner*—Ardith Hertzog

*Attorney, Agent, or Firm*—Wayne C. Jaeschke; John E. Drach; Henry E. Millson, Jr.

[57] ABSTRACT

Aqueous solutions of anionic surfactants having improved low-temperature stability are obtained by addition to the solutions of mixtures of nonionic surfactants containing a) alkyl and/or alkenyl oligoglycosides corresponding to formula (I)

$$R^1\text{-O-}[G]_p \qquad \text{(I)}$$

in which $R^1$ is an alkyl and/or alkenyl radical containing 6 to 22 carbon atoms, G is a sugar unit containing 5 or 6 carbon atoms and p is a number of 1 to 10, b) fatty alcohol polyglycol ethers corresponding to formula (II)

$$R^2O-(CH_2\overset{\overset{CH_3}{|}}{C}HO)_m(CH_2CH_2O)_nH \qquad \text{(II)}$$

in which $R^2$ is an alkyl radical containing 8 to 11 carbon atoms, n is a number of 4 to 9 and m=0 or is a number of 1 to 3, and optionally c) fatty alcohol polyglycol ethers corresponding to formula (III)

$$R^3O-(CH_2\overset{\overset{CH_3}{|}}{C}HO)_m(CH_2CH_2O)_nH \qquad \text{(III)}$$

in which $R^3$ is an alkyl radical containing 12 to 15 carbon atoms, n is an integer of 4 to 9 and m=0 or is a number of 1 to 3.

The products are particularly suitable for the production of manual dishwashing detergents.

6 Claims, No Drawings

AQUEOUS ANIONIC SURFACTANT SOLUTIONS STABLE AT LOW TEMPERATURE COMPRISING GLYCOSIDE AND ALKOXYLATED NONIONIC SURFACTANT MIXTURES AND PROCESSES OF MAKING SAME

BACKGROUND OF THE INVENTION

1. Field of the Invention

This invention relates to a process for improving the low-temperature stability of aqueous anionic surfactant solutions by addition of a mixture of selected nonionic surfactants, to manual dishwashing detergents containing these mixtures and to the use of this mixture for the production of aqueous anionic surfactant solutions having improved low-temperature stability.

2. Statement of the Related Art

Most manual dishwashing detergents contain anionic surfactants as their active components. Typical primary surfactants are alkylbenzene sulfonates, secondary alkane sulfonates, fatty alcohol ether sulfates and alkyl sulfates. These surfactants are present in the formulations in total concentrations of up to about 30% by weight, high-performance synergistic combinations essentially being used. Suitable co-surfactants or secondary surfactants are, for example, betaines, fatty acid alkanolamides, amine oxides and ether carboxylic acids which are used in much smaller quantities. Their function is to increase washing power and foam stability (cf. Seifen-Öle-Fette-Wachse 115, 149 (1989)).

One of the problems involved in the formulation of such detergents lies in the comparatively poor low-temperature stability of aqueous anionic surfactant solutions. Accordingly, unwanted clouding can occur, particularly when formulations or part-formulations have to be stored for a certain time before use. If it is stored outside, the product can even solidify.

In this connection, foaming detergent mixtures of anionic surfactants, alkyl oligoglucosides and, optionally, amine oxides and their use as dishwashing detergents are proposed in European patents EP-B 0 070 074, EP-B 0 070 075, EP-B 0 070 076 and in EP-B 0 075 995 and EP-B 0 075 996 (Procter & Gamble). However, the low-temperature stability of the mixtures is not significantly improved by the addition of the nonionic surfactants mentioned.

In addition, German patent application DE-A1 40 25 065 (Henkel) describes aqueous surfactant mixtures which, in addition to alkyl oligoglucosides and mixtures of long-chain and short-chain alkyl sulfates, may also contain fatty alcohol polyethylene glycol ethers, preferably adducts of 3 to 10 mol ethylene oxide with $C_{10-20}$ fatty alcohols. The surfactant compounds are used as premixes in the production of liquid detergents. However, this patent application does not refer to the low-temperature stability of the mixtures or to their advantageous use in manual dishwashing detergents.

Accordingly, the problem addressed by the present invention was to provide a process for the production of aqueous anionic surfactant solutions which would be free from the disadvantages mentioned above.

DESCRIPTION OF THE INVENTION

The present invention relates to a process for the production of aqueous solutions of anionic surfactants having improved low-temperature stability, in which mixtures of nonionic surfactants containing a) alkyl and/or alkenyl oligoglycosides corresponding to formula (I)

$$R^1\text{-O-}[G]_p \qquad \text{(I)}$$

in which $R^1$ is an alkyl and/or alkenyl radical containing 6 to 22 carbon atoms, G is a sugar unit containing 5 or 6 carbon atoms and p is a number of 1 to 10, b) fatty alcohol polyglycol ethers corresponding to formula (II)

$$R^2O-(CH_2\overset{\overset{\displaystyle CH_3}{|}}{C}HO)_m(CH_2CH_2O)_nH \qquad \text{(II)}$$

in which $R^2$ is an alkyl radical containing 8 to 11 carbon atoms, n is a number of 4 to 9 and m=0 or is a number of 1 to 3, and optionally c) fatty alcohol polyglycol ethers corresponding to formula (III)

$$R^3O-(CH_2\overset{\overset{\displaystyle CH_3}{|}}{C}HO)_m(CH_2CH_2O)_nH \qquad \text{(III)}$$

in which $R^3$ is an alkyl radical containing 12 to 15 carbon atoms, n is an integer of 4 to 9 and m=0 or is a number of 1 to 3, are added to the surfactant solutions.

The aqueous solutions of which the low-temperature behavior is to be improved by the process according to the invention may contain, for example, artionic surfactants selected from the group consisting of alkylbenzene sulfonates, alkane sulfonates, olefin sulfonates, alkyl ether sulfonates, glycerol ether sulfonates, α-methyl ester sulfonates, sulfofatty acids, alkyl sulfates, fatty alcohol ether sulfates, glycerol ether sulfates, hydroxy mixed ether sulfates, monoglyceride (ether) sulfates, fatty acid amide (ether) sulfates, soaps, sulfosuccinates, sulfosuccinamates, sulfotriglycerides, isethionates, taurides, sarcosinates, ether carboxylic acids, alkyl oligoglucoside sulfates and alkyl (ether) phosphates and also betaine surfactants. Where the anionic surfactants contain polyglycol ether chains, they may have both a conventional and also a narrow-range homolog distribution.

The surfactants mentioned are all known compounds. Information on the structure and production of these substances can be found in relevant synoptic works, cf. for example J. Falbe (ed.), "Surfactants in Consumer products", Springer Verlag, Berlin, 1987, pages 54 to 124 or J. Falbe (ed.), "Katalysatoren, Tenside and Mineralöladditive (Catalysts, Surfactants and Mineral Oil Additives)", Thieme Verlag, Stuttgart, 1978, pages 123–217.

Aqueous solutions of the anionic surfactants mentioned in which the anionic surfactants are present in quantities of 1 to 50% by weight and preferably 25 to 35% by weight are preferably used.

Alkyl and alkenyl oligoglycosides are known substances which may be obtained by the relevant methods of preparative organic chemistry. EP-A1-0 301 298 and WO 90/3977 are cited as representative of the extensive literature available on this subject.

The alkyl and/or alkenyl oligoglycosides may be derived from aldoses or ketoses containing 5 or 6 carbon atoms, preferably glucose. Accordingly, the preferred alkyl and/or alkenyl oligoglycosides are alkyl and/or alkenyl oligoglucosides.

The index p in general formula (I) indicates the degree of oligomerization (DP degree), i.e. the distribution of mono- and oligoglycosides, and is a number of 1 to 10. Whereas p in a given compound must always be an integer and, above all, may assume a value p of 1 to 6, the value p for a certain alkyl oligoglycoside is an analytically determined calculated quantity which is generally a broken number. Alkyl and/or alkenyl oligoglycosides having an average degree of oligomerization p of 1.1 to 3.0 are preferably used. Alkyl and/or alkenyl oligoglycosides having a degree of oligomerization of less than 1.7 and, more particularly, between 1.2 and 1.4 are preferred from the applicational point of view.

The alkyl or alkenyl radical $R^1$ may be derived from primary alcohols containing 6 to 11 and preferably 8 to 10 carbon atoms. Typical examples are caproic alcohol, caprylic alcohol, capric alcohol and undecyl alcohol and technical mixtures thereof such as are obtained, for example, in the hydrogenation of technical fatty acid methyl esters or in the hydrogenation of aldehydes from Roelen's oxo synthesis. Alkyl oligoglucosides having a chain length of $C_8$ to $C_{10}$ (DP=1 to 3), which are obtained as first runnings in the separation of technical $C_{8-18}$ coconut oil fatty alcohol by distillation and which may contain less than 15% by weight and preferably less than 6% by weight $C_{12}$ alcohol as an impurity, and also alkyl oligoglucosides based on technical $C_{9/11}$ oxoalcohols (DP=1 to 3) are preferred.

In addition, the alkyl or alkenyl radical $R^1$ may also be derived from primary alcohols containing 12 to 22 and preferably 12 to 14 carbon atoms. Typical examples are lauryl alcohol, myristyl alcohol, cetyl alcohol, palmitoleyl alcohol, stearyl alcohol, isostearyl alcohol, oleyl alcohol, elaidyl alcohol, petroselinyl alcohol, arachyl alcohol, gadoleyl alcohol, behenyl alcohol, erucyl alcohol, and technical mixtures thereof which may be obtained as described above. Alkyl oligoglucosides based on hydrogenated $C_{12/14}$ coconut oil fatty alcohol having a DP of 1 to 3 are preferred.

One particular embodiment of the invention is characterized by the use of alkyl oligoglucosides in the form of mixtures of the above-mentioned short-chain $C_{8-11}$ alkyl oligoglucosides and long-chain $C_{12-14}$ alkyl oligoglucosides in a ratio by weight of 95:5 to 40:60 and, more particularly, 90:10 to 50:50.

The fatty alcohol polyglycol ethers mentioned as components b) and c) are also basically known substances which may be obtained on an industrial scale by addition of ethylene and/or propylene oxide onto primary alcohols, predominantly fatty alcohols or oxoalcohols. Depending on the catalyst system used for the alkoxylation reaction, it is possible in this way to obtain nonionic surfactants which have a conventional or narrow-range homolog distribution and which are equally suitable for use as part of the mixture of nonionic surfactants.

According to formula (II), the fatty alcohol polyglycol ethers forming component b) are adducts of ethylene and/or propylene oxide with primary alcohols containing 8 to 11 carbon atoms. Typical examples are the adducts of, on average, 4 to 9 and preferably 5 to 7 mol ethylene oxide or 1 mol propylene oxide with octanol, decanol or a $C_{8-10}$ head-fraction fatty alcohol.

According to formula (III), adducts of ethylene and/or propylene oxide with primary alcohols containing 12 to 15 carbon atoms are correspondingly suitable for the fatty alcohol polyglycol ethers forming the optional component c). Typical examples are adducts of, on average, 4 to 9 and preferably 5 to 7 mol ethylene oxide or 1 mol propylene oxide with lauryl alcohol or a $C_{12-14}$ coconut oil fatty alcohol.

If the fatty alcohol polyglycol ethers forming components b) and c) contain ethylene and propylene glycol units, the ethylene glycol units are preferably positioned at the end of the molecule.

In the process according to the invention, the nonionic surfactants mentioned consisting of components a), b) and optionally c) may be added to the aqueous solutions of anionic surfactants in such quantities that the ratio by weight of anionic surfactant to nonionic surfactant in the solutions is from 98:2 to 20:80 and preferably from 95:5 to 50:50.

If the mixture of nonionic surfactants is regarded as a compound which is added to the anionic surfactant solutions, this compound may contain components a) and b+c) in a ratio by weight of 90:10 to 40:60, preferably in a ratio by weight of 80:20 to 50:50 and, more preferably, in a ratio by weight of 70:30 to 50:50, while components b) and c) may be used in a ratio by weight to one another of 100:0 to 70:30.

The production of the mixtures of nonionic surfactants and the preparation of the low-temperature-stabilized anionic surfactant mixtures may be carried out purely mechanically, preferably by stirring, optionally at elevated temperatures of 30° to 40° C.; no chemical reaction takes place.

The present invention also relates to water-based manual dishwashing detergents having improved low-temperature stability containing anionic surfactants and a) alkyl and/or alkenyl oligoglycosides corresponding to formula (I)

$$R^1\text{-O-}[G]_p \qquad \text{(I)}$$

in which $R^1$ is an alkyl and/or alkenyl radical containing 6 to 22 carbon atoms, G is a sugar unit containing 5 or 6 carbon atoms and p is a number of 1 to 10, b) fatty alcohol polyglycol ethers corresponding to formula (II)

$$R^2O-(\overset{\overset{\displaystyle CH_3}{|}}{CH_2CHO})_m(CH_2CH_2O)_nH \qquad \text{(II)}$$

in which $R^2$ is an alkyl radical containing 8 to 11 carbon atoms, n is a number of 4 to 9 and m=0 or is a number of 1 to 3, and optionally c) fatty alcohol polyglycol ethers corresponding to formula (III)

$$R^3O-(\overset{\overset{\displaystyle CH_3}{|}}{CH_2CHO})_m(CH_2CH_2O)_nH \qquad \text{(III)}$$

in which $R^3$ is an alkyl radical containing 12 to 15 carbon atoms, n is an integer of 4 to 9 and m=0 or is a number of 1 to 3.

In addition to the anionic surfactants mentioned by way of example in the foregoing, the water-based dishwashing detergents according to the invention may contain other typical constituents, for example amphoteric surfactants, foam boosters, fragrances, etc. A typical formulation may contain, for example, 20% by weight fatty alcohol ether sulfate, 15% by weight secondary alkane sulfonate, 3% by weight alkyl amidobetaine and 2% by weight of the nonionic surfactant mixture according to the invention (water ad 100% by weight).

INDUSTRIAL APPLICATIONS

According to the invention, the addition of the mixtures of nonionic surfactants to the aqueous anionic surfactant solutions lowers the low-temperature cloud point without adversely affecting the dishwashing performance of the mixtures.

Accordingly, the present invention relates to the use of mixtures of nonionic surfactants containing a) alkyl and/or alkenyl oligoglycosides corresponding to formula (I)

$$R^1\text{-O-}[G]_p \quad (I)$$

in which $R^1$ is an alkyl and/or alkenyl radical containing 6 to 22 carbon atoms, G is a sugar unit containing 5 or 6 carbon atoms and p is a number of 1 to 10, b) fatty alcohol polyglycol ethers corresponding to formula (II)

$$R^2O-(CH_2\overset{\overset{CH_3}{|}}{C}HO)_m(CH_2CH_2O)_nH \quad (II)$$

in which $R^2$ is an alkyl radical containing 8 to 11 carbon atoms, n is a number of 4 to 9 and m=0 or is a number of 1 to 3, and optionally c) fatty alcohol polyglycol ethers corresponding to formula (III)

$$R^3O-(CH_2\overset{\overset{CH_3}{|}}{C}HO)_m(CH_2CH_2O)_nH \quad (III)$$

in which $R^3$ is an alkyl radical containing 12 to 15 carbon atoms, n is an integer of 4 to 9 and m=0 or is a number of 1 to 3, for improving the low-temperature stability of aqueous solutions of anionic surfactants.

The following Examples are intended to illustrate the invention without limiting it in any way.

EXAMPLES

I. Surfactants used

A1) $C_{12/14}$ coconut oil alkyl oligolgucoside, DP degree: 1.35 Plantaren® APG 600 CS UP B1) Octanol 4EO, deodorized Dehydol® O4 "DEO"

B2) Octanol 7EO, deodorized

B3) Decanol 7EO, deodorized

B4) $C_{10/14}$ fatty alcohol 7EO (narrow-range)

C1) $C_{12/14}$ coconut oil alcohol 3.5 EO sulfate sodium salt Texapon® LS35

C2) $C_{12/}$_coconut oil alcohol 2.8 EO sulfate sodium salt Texapon® K14S28

D1) Betaine based on $C_{12/14}$ coconut oil fatty acid Dehyton® G

D2) Betaine based on $C_{12/14}$ coconut oil fatty acid Dehyton® K

All the surfactants used are commercial products of Henkel KGaA, Düsseldorf/FRG.

II. Test methods a) Low-temperature behavior

The test formulations were transferred to a thermostat where they were cooled from +20° C. to at most −6° C. (2° C./10 mins.). The low-temperature cloud point (LTCP) is the temperature at which the clear solution turns cloudy. The test results are set out in Tables 1 and 2.

b) Dishwashing performance (DWP)

Dishwashing performance was determined by the saucer test [Fette, Seifen, Antstrichmitt., 74, 163 (1972)]. To this end, 14 cm diameter saucers were each soiled with 1.9 g beef tallow (melting point 40°–42° C., acid value 9–10) and stored for 15 h at a temperature of 0° to 5° C. The saucers were then washed at 50° C. with tapwater having a hardness of 16° d. The test mixture was used in a dosage of 0.15 water. The washing test was terminated when the foam covering on the surface broke up and the underlying liquor became visible. The results of the dishwashing tests, expressed as the number of clean saucers (S), are set out in Tables 1 and 2.

TABLE 1

Test results of formulation I
Percentages as % by weight
Addition of 5% ethanol and water to 100%

| Ex. | A1 % | B1 % | B2 % | B3 % | B4 % | C1 % | C2 % | D1 % | LTCP °C. | DWP S |
|---|---|---|---|---|---|---|---|---|---|---|
| 1 | 6 | 5 | — | — | — | 15 | 18 | 3 | <−6 | 9 |
| 2 | 6 | — | 5 | — | — | 15 | 18 | 3 | −4 | 13 |
| 3 | 4 | — | 10 | — | — | 10 | 12 | 2 | <−6 | 8 |
| 4 | 6 | — | — | 5 | — | 15 | 18 | 3 | −4 | 12 |
| 4 | 4 | — | — | 10 | — | 10 | 12 | 2 | <−6 | 8 |
| 5 | 6 | — | — | — | 5 | 15 | 18 | 3 | −3 | 12 |
| 6 | 4 | — | — | — | 10 | 10 | 12 | 2 | <−6 | 9 |
| C1 | 8 | — | — | — | — | 20 | 25 | 4 | +3 | 13 |

C1 represents the composition of a commercially available product.

TABLE 2

Test results of formulation II
Percentages as % by weight
Addition of water to 100%

| Ex. | A1 % | B1 % | B2 % | B3 % | B4 % | C1 % | C2 % | D2 % | LTCP °C. | DWP S |
|---|---|---|---|---|---|---|---|---|---|---|
| 7 | 16 | 5 | — | — | — | 35 | — | 6 | −2 | 14 |
| 8 | 13 | 10 | — | — | — | 27 | — | 4 | <−6 | 14 |
| 9 | 9 | 15 | — | — | — | 19 | — | 3 | <−6 | 11 |
| 10 | 16 | — | 5 | — | — | 35 | — | 6 | −2 | 15 |
| 11 | 13 | — | 10 | — | — | 27 | — | 4 | <−6 | 14 |
| 12 | 9 | — | 15 | — | — | 19 | — | 3 | <−6 | 12 |
| 13 | 13 | — | — | 10 | — | 27 | — | 4 | <−6 | 13 |
| 14 | 9 | — | — | 15 | — | 19 | — | 3 | <−6 | 12 |
| C2 | 20 | — | — | — | — | 43 | — | 7 | +4 | 15 |

C2 represents the composition of a commercially available product.

What is claimed is:

1. An additive for addition to an aqueous solution of one or more anionic surfactants to improve the low-temperature stability thereof consisting of a mixture of the following nonionic surfactants:

(a) at least one alkyl or alkenyl oligoglycoside of formula (I):

$$R^1\text{-O-}(G)_p \quad (I)$$

wherein $R^1$ is an alkyl or alkenyl radical having from about 6 to about 22 carbon atoms, G is a sugar unit having from 5 to 6 carbon atoms and p is a number from 1 to 10;

(b) at least one fatty alcohol polyglycol ether of the formula (II):

$$R^2O-(CH_2\overset{\overset{CH_3}{|}}{C}HO)_m(CH_2CH_2O)_nH \quad (II)$$

wherein $R^2$ is an alkyl radical having from about 8 to about 11 carbon atoms, n is a number from about 4 to about 9 and m=0 or is a number from 1 to 3; and, optionally, (c) at least one fatty alcohol polyglycol ether of the formula (III):

$$R^3O-(CH_2\overset{\overset{\displaystyle CH_3}{|}}{C}HO)_m(CH_2CH_2O)_nH \quad \text{(III)}$$

wherein $R^3$ is an alkyl radical having from about 12 to about 15 carbon atoms, n is an integer from about 4 to about 9 and m=0 or is a number from 1 to 3.

2. The additive of claim 1 wherein in component (a) $R^1$ is an alkyl or alkenyl radical having from about 6 to about 11 carbon atoms, G is a glucose unit and p is a number from 1 to 3.

3. The additive of claim 1 wherein in component (a) $R^1$ is an alkyl or alkenyl radical having from about 12 to about 22 carbon atoms, G is a glucose unit and p is a number from 1 to 3.

4. The additive of claim 1 wherein the weight ratio of component (a) to components (b+c) is from about 90:10 to about 40:60.

5. The additive of claim 1 wherein the weight ratio of components (b) to (c) is from about 100:0 to about 70:30.

6. A process for the production of an aqueous solution comprised of one or more anionic surfactants having improved low-temperature stability comprising the steps of: (1) adding to said aqueous solution a low-temperature stabilizing quantity of a mixture consisting of the following nonionic surfactants to form a surfactant composition which is stable at low temperatures (a) at least one alkyl or alkenyl oligoglycoside of formula (I):

$$R^1\text{-O-}(G)_p \quad \text{(I)}$$

wherein $R^1$ is an alkyl or alkenyl radical having from about 6 to about 22 carbon atoms, G is a sugar unit having from 5 to 6 carbon atoms and p is a number from 1 to 10; (b) at least one fatty alcohol polyglycol ether of the formula (II):

$$R^2O-(CH_2\overset{\overset{\displaystyle CH_3}{|}}{C}HO)_m(CH_2CH_2O)_nH \quad \text{(II)}$$

wherein $R^2$ is an alkyl radical having from about 8 to about 11 carbon atoms, n is a number from about 4 to about 9 and m=0 or is a number from 1 to 3 and, optionally, (c) at least one fatty alcohol ether of the formula (III):

$$R^3O-(CH_2\overset{\overset{\displaystyle CH_3}{|}}{C}HO)_m(CH_2CH_2O)_nH \quad \text{(III)}$$

wherein $R^3$ is an alkyl radical having from about 12 to about 15 carbon atoms, n is an integer from about 4 to about 9 and m=0 or is a number from 1 to 3; and (2) storing the resulting aqueous solution.

* * * * *